United States Patent [19]

Klöckner et al.

[11] Patent Number: 4,590,778

[45] Date of Patent: May 27, 1986

[54] POSITIONING CONTROL DEVICE FOR GUIDANCE FEED MEMBERS AT THE ENTRANCE OF A HOT-ROLLED WIDE STRIP FINISH ROLLING MILL TRAIN

[75] Inventors: Jürgen Klöckner, Netphen-Eschenbach; Dieter Rosenthal, Niederfischbach, both of Fed. Rep. of Germany

[73] Assignee: SMS Schloemann-Siemag AG, Dusseldorf, Fed. Rep. of Germany

[21] Appl. No.: 749,287

[22] Filed: Jun. 26, 1985

[30] Foreign Application Priority Data

Jun. 27, 1984 [DE] Fed. Rep. of Germany ..... 3423560

[51] Int. Cl.[4] ..... B21B 37/08; B21B 39/20

[52] U.S. Cl. ..... 72/19; 72/250

[58] Field of Search ..... 72/19, 250, 252, 8; 226/196, 199

[56] References Cited

U.S. PATENT DOCUMENTS 4,073,173 2/1978 Marshall et al. ..... 72/250

4,096,725 6/1978 Kano ..... 72/250

*Primary Examiner*—Francis S. Husar

*Assistant Examiner*—Jorji M. Griffin

*Attorney, Agent, or Firm*—Toren, McGeady, Stanger, Goldberg & Kiel

[57] ABSTRACT

In a positioning control device for guiding the side edges of an elongated strip at the entrance into a hot-rolled wide strip finish rolling mill train, guidance feed members are displaced transversely of the rolling direction by piston-cylinder assemblies. Appropriate displacement of the guidance feed members depends on continuously transmitted measured actual values of the strip position within the rolling train which are compared with preset required values. If the width of the strip exceeds a nominal width then large deformation of the strip side edges occurs along with axial reaction forces in the roller supports of the first rolling stand in the finish rolling mill. To avoid damage to the first rolling stand and to the strip, a pressure regulation is superimposed on the position regulation and depending on a comparison of the actual value of the measured upsetting force acting along the strip side edges with a predetermined required value, a correction-setting signal is generated for the displacement of the guidance feed members in the opening or closing direction relative to one another.

3 Claims, 2 Drawing Figures

POSITIONING CONTROL DEVICE FOR GUIDANCE FEED MEMBERS AT THE ENTRANCE OF A HOT-ROLLED WIDE STRIP FINISH ROLLING MILL TRAIN

BACKGROUND OF THE INVENTION

The present invention is directed to a positioning control device for guide members powered by piston-cylinder assemblies for guiding the side edges of strip at the entrance into a hot-rolled wide strip finish rolling mill train. The guide members are displaceable transversely of the rolling direction. The control is effected by comparing continuously supplied measured values of the strip position within the finish rolling train with preset required values and generating a setting or adjustment signal for each position regulating circuit assigned to the piston under assemblies so that an appropriate displacement of one or both of the guide members can be effected.

Positioning control devices of this general type are based on the knowledge gained from practical experience in that the strip position in the finish rolling trail is identical with the shape and position of the rough strip. In other words, straight rough strips have an appropriately straight and sound strip run if the finish rolling train is properly set with the guide members only holding the strip and any drifting of the strip side edges against the guide members causes the strip to run off. Guidance members for the side edges of the strip arranged ahead of the first roller stand of the finish rolling train has a definite influence on the run of the strip through train, it can influence the position of the strip and thus the passing of the strip through finish rolling train.

In one known arrangement of a positioning control of this type set forth in German Offenlegungsschrift 31 16 278, the side edges of the hot rolled wide strip, prior to passing into the first stand of the finish rolling train, are directed by guide rollers movable in slide guides transversely of the rolling direction. The sliding movement in the guides is effected by adjustment motors which are components of the positioning regulation circuits. With these adjustment motors it is possible to counteract any displacements of the run of the strip from its normal track before such displacement becomes apparent, since the comparative evaluation of the measuring results transmitted from the measuring devices located within the finish rolling train, determines a tendency of the strip to run from the normal path in sufficient time so that a counteracting positional change can be effected by displacing the guide rollers. This known device utilizes specially elastically deformable transverse beams, which at small elastic deformations trigger signals by means of strain measuring gauges when the pressure on the side edges of the rolling strip exceeds predetermined values.

Such positioning control has proved effective for the side guidance of essentially normal rough strips. Difficulties occur, however, when the end of a rough strip is wider than its nominal width. In such a situation, the end of the rough strip is forced by the first finish stand through the side guidance and may stress the guidance members to a multiple of the normal load. As a result, large deformations can occur on one of the side edges of the strip and this may possibly lead to buckling of the strip. Further, such excessive load can lead to large axial reaction forces in the supports for the rollers of the first rolling stand in the finish train. Such reaction stresses occur if the strip end is curved along one side edge. In such a situation, the strip end abuts along the side edge at one of the side guidance members and presses against it with a comparatively greater force. The reaction forces must be absorbed by the axial support of the rollers in the first rolling stand of the finish train and can lead to damage of the supports. The known position control devices do not react to such conditions, or they react in an incorrect manner, since the indicated position of the strip is correct for the measuring devices within the finish rolling train and the possibly existing measuring devices merely indicate the excess of the predetermined required value for the side pressure and cause the generation of correction signals for the restoration of the straight run of the strip.

SUMMARY OF THE INVENTION

Therefore, the primary object of the present invention is to improve the positioning control device of the above type so that the harmful effects of the strips on the side guidance members, the strip and the supports or journals are avoided by the manner of operation of the positioning control device when the strips are too wide or have bent strip ends. Accordingly, the improved positioning control devices involves the superimposition of a pressure adjustment on the positional adjustment which, depending on a comparison of the actual value of the measured upsetting force occuring due to the force action of the strip edge on a side guide member or feed roller with a predetermined required value, generates a correction-setting signal for the displacement of both of the guidance members in the opening or closing direction. If the upsetting force exceeds the specific amount depending on the strip width, the strip thickness, and the mean tensile strength, then the correction-setting signal developed causes, due to the position regulation circuit, a displacement of both of the guidance members for the strip edges away from one another in the opening direction until the upsetting force has been reduced to an acceptable preset value.

Further, in accordance with the present invention, the harmful high support or journal loads, as a consequence of curved strip ends, are avoided by supplying an additional correction-adjusting signal for the position regulation of the guidance members by a monitoring regulator. This takes place if the difference of the upsetting forces at the drive side and the operating side, which is being constantly measured, exceeds a predetermined differential required value. As a result, an appropriate displacement movement of the guidance member which is more highly stressed occurs in the opening direction, that is, away from the edge of the strip.

By moving the guidance members for the side of the strip in the opening or closing direction with a corresponding regulation the width of the rough strip can be corrected within a limited extent without deforming the edges of the strip or buckling the strip.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
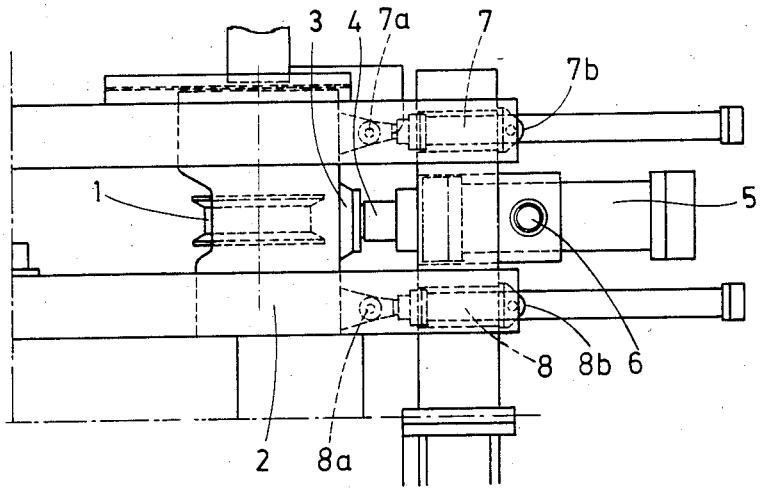
FIG. 1 is a schematic elevational view of one of the two side guidance members as viewed in the rolling direction.

As illustrated in FIG. 1, the guidance members or guidance feed rollers 1 are supported in a box 2 and are displaceable transversely of the rolling direction. Box 2 includes an abutment plate 3 directed outwardly from the guidance roller 1 and the front face of piston 4 of the piston-cylinder assembly 5 acts against the abutment plate. The cylinder of the piston-cylinder assembly 5 is rotatably supported about a fixed axis 6 extending parallel to the rolling direction of the strip through the finish rolling mill train. Spaced one above and the other below the piston-cylinder assembly 5 are the balancing or equalizing piston-cylinder assemblies 7, 8, each having an axis *7a, 8a* extending parallel to the rolling direction and articulating the balancing piston-cylinder assemblies at the box 2. Further, each piston-cylinder assemblies 7, 8 is pivotally mounted about a permanent fixed axis *7b, 8b* which also extends parallel to the rolling direction through the rolling mill train. The arrangement of the piston-cylinder assembly 5 with its piston acting against the abutment plate 3, permits in combination with the two balancing piston-cylinder assemblies 7, 8 action upon the edges of the strip, not shown, being rolled by the guidance feed rollers 1 with a high pressure for achieving an upsetting effect. The two balancing piston-cylinder assemblies 7, 8 pull the box with the abutment plate 3 practically without any play against the front face of the piston bore of the piston-cylinder assembly 5.

Figure 2:
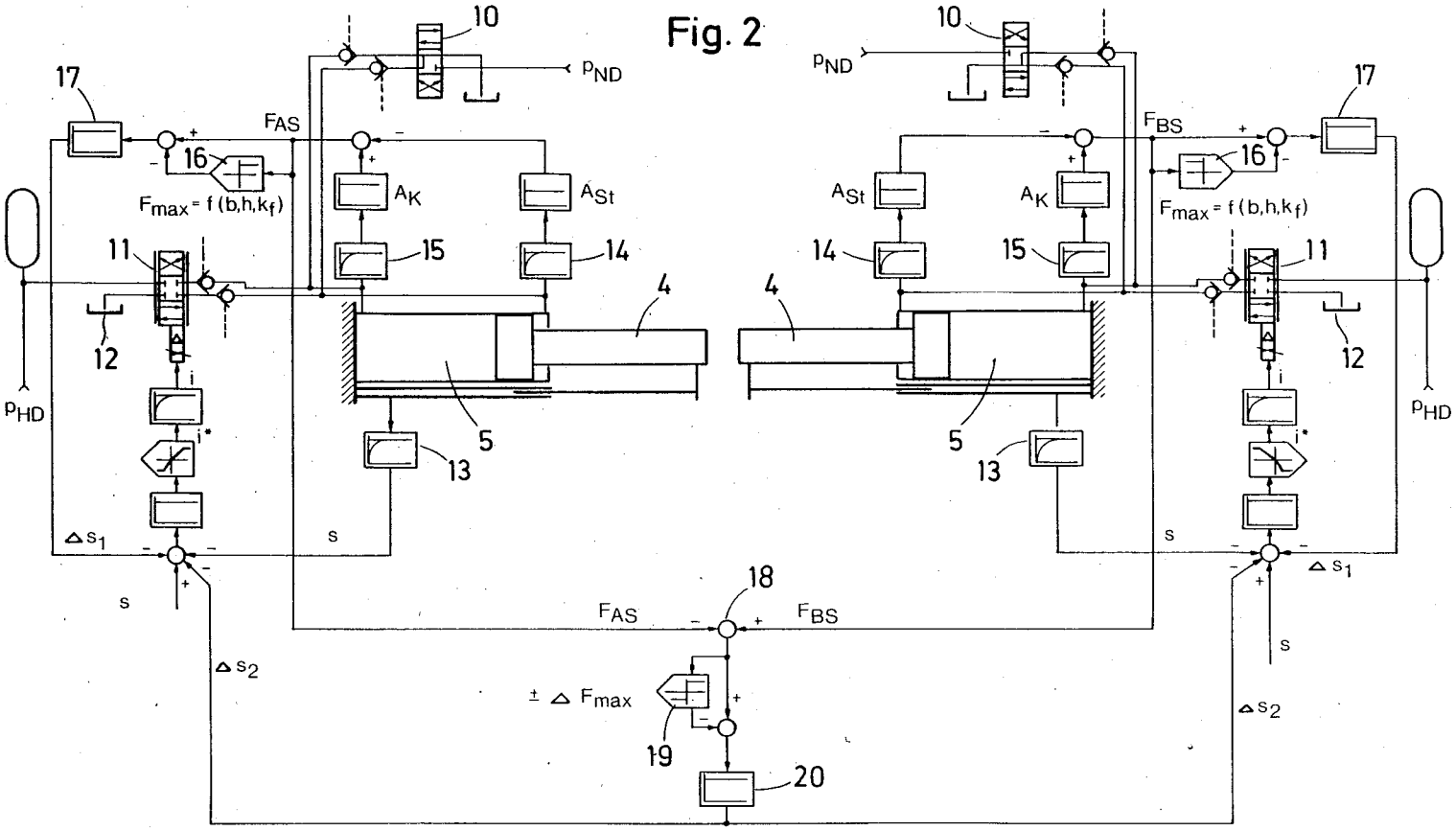
FIG. 2 is a diagram of the position regulation arrangement.

The circuit diagram for position control as shown in FIG. 2 displays the arrangement and connection of the circuit elements. In this arrangement a low pressure (ND) system serves for traversing long paths. The piston-cylinder assembly 5 on the drive side and the operating side are connected with the ND pumps by switching valves 10. The available traversing speed results from the pump capacity and the cylinder dimensions. By means of the ND system the gauged gap between the guidance rollers can be entered in a rough manner. Subsequently, accurate positioning by means of the position regulation of the piston-cylinder assembly 5 takes place. If there is a cutout of the HD (high pressure) system the balancing piston-cylinder assemblies 7, 8, note FIG. 1, automatically draw back the piston 4 of the piston-cylinder assembly 5 so that in the event of such a cutout one can continue rolling in the rolling mill.

The piston or piston rod side of the piston-cylinder assembly 5 are, according to the direction of motion, acted upon by system pressure through a servo valve 11 or through connection with a tank 12. The storage containers arranged in the direct vicinity of the servo valves 11 are dimensioned in such a way that small displacement movement can be accomplished without any considerable pressure loss in the storage containers. The capacity of the HD pump, not shown, is therefore small.

The circuit amplification of the position regulation circuit with a position transmitter 13 on the drive side and the operating side is made up of an electrical and an hydraulic portion. If a required actual deviation is registered, then the servo valve 11 is opened by a certain amount corresponding to the electrical magnification via the position and current regulator. The traversing speed which then takes place is proportional not only to the valve opening, but also depends on the pressure gradient at the control edge of the servo valve 11. This pressure gradient is determined by the upsetting force and by the system pressure. The circuit amplification of the positioning regulation circuit is, therefore, force-dependent.

Two pressure transmitters 14, 15 measure the upsetting force on the drive side and the operating side. If, for instance, the measured force exceeds the preset required value 16, then the pressure regulator 17 delivers a correction signal $\Delta s_1$ for the position regulation circuit. This causes a displacement of the feeding straight edges or feeding rollers away from one another so that the space between them is open until the upsetting force has been reduced to the acceptable preset value.

The differential upsetting force between the drive side and the operating side is continuously determined at the summation member 18. If this force exceeds the preset requirement value 19, the monitoring regulator 20 supplies correction signals $\Delta s_2$ for the position regulation circuit. This leads to the higher loaded guidance straight edge or guidance roller for movement in the opening direction away from the strip edge so that stressing of the roller supports in the first stand of the finish train is avoided.

While specific embodiments of the invention have been shown and described in detail to illustrate the application of the inventive principles, it will be understood that the invention may be embodied otherwise without departing from such principles.

We claim:

1. Positioning control device for guiding the side edges of a strip at the entrance into a hot-rolled wide strip finish rolling mill train having a rolling direction, comprising guidance feed members arranged to guide the opposite side edges of the strip, said guidance feed members being displaceable transversely of the rolling direction, a piston-cylinder assembly in operative engagement with each of said guidance feed members for displacing said feed members transversely of the rolling direction, a position regulation circuit for each said piston-cylinder assembly, first means for continuously supplying measured values of the position of the strip within the finish rolling train as adjustment signals to said position regulation circuits after comparing the actual values with a preset required value for effecting an appropriate displacement of said guidance feed members, wherein the improvement comprises second means for comparing the actual value of the measured upsetting force acting on the strip edge by said guidance feed members in comparison with a predetermined required value for generating a correction-setting signal, and third means for superimposing a pressure regulation on the position regulation so that in dependence upon the correction-setting signal from said first means a displacement of said guide feed members can be effected.

2. Positioning control device, as set forth in claim 1, wherein a monitoring control for the comparison of the differences between the upsetting forces occurring at the guidance members with a predetermined value affords a correction-setting signal and said signal causes a displacement of the guidance members in the opening direction.

3. Positioning control device, as set forth in claim 1 or 2 wherein each said guidance member includes a sliding carriage displaceable transversely of the rolling direction and a guide roller supported in said carriage, said carriage comprises an abutment plate located outwardly from said guide roller, said abutment plate having an abutment surface extending parallel to the rolling direction, said piston-cylinder assembly includes a piston having a front face bearing against the abutment surface of said abutment plate, said piston cylinder assembly having a cylinder housing pivotally mounted about a permanent fixed axis extending parallel to the rolling direction, and a pair of balancing piston-cylinder assemblies each on an opposite side of said piston-cylinder assembly and articulated by an axis extending parallel to the rolling direction with said carriage and said balancing piston-cylinder assemblies each having a cylinder housing pivotally mounted about a permanent fixed axis extending parallel to the rolling direction.

* * * * *